US011796272B2

(12) United States Patent
Potter

(10) Patent No.: US 11,796,272 B2
(45) Date of Patent: Oct. 24, 2023

(54) RIFLE BEDDING ASSEMBLY

(71) Applicant: Dwight Mitchel Potter, Savage, MT (US)

(72) Inventor: Dwight Mitchel Potter, Savage, MT (US)

( * ) Notice: Subject to any disclaimer, the term of this patent is extended or adjusted under 35 U.S.C. 154(b) by 0 days.

(21) Appl. No.: 17/979,314

(22) Filed: Nov. 2, 2022

(65) Prior Publication Data

US 2023/0168060 A1 Jun. 1, 2023

Related U.S. Application Data

(60) Provisional application No. 63/284,822, filed on Dec. 1, 2021.

(51) Int. Cl.
*F41A 21/48* (2006.01)
*F41A 3/66* (2006.01)

(52) U.S. Cl.
CPC ..... *F41A 21/487* (2013.01); *F41A 3/66* (2013.01); *F41A 21/482* (2013.01)

(58) Field of Classification Search
CPC ..... F41A 21/487; F41A 21/482
See application file for complete search history.

(56) References Cited

U.S. PATENT DOCUMENTS

| | | | | | |
|---|---|---|---|---|---|
| 4,473,964 | A * | 10/1984 | Straub | H01L 31/095 257/E31.094 |
| 4,519,158 | A | 5/1985 | Shaw | |
| 4,571,871 | A | 2/1986 | Timari | |
| 5,410,834 | A | 5/1995 | Brown | |
| 5,794,374 | A | 8/1998 | Crandall | |
| 7,841,119 | B1 * | 11/2010 | Boyd | F41C 23/16 42/71.01 |
| 8,881,444 | B2 * | 11/2014 | Warburton | F41C 23/06 42/74 |
| 10,267,599 | B1 | 4/2019 | Britt | |
| 10,539,387 | B1 * | 1/2020 | Joplin | F41A 21/487 |
| 10,859,342 | B2 * | 12/2020 | Ludlow | F41C 23/16 |
| 2020/0132407 | A1 | 4/2020 | Joplin et al. | |

FOREIGN PATENT DOCUMENTS

| | | | | |
|---|---|---|---|---|
| BR | 112017016781 | B1 | 10/2021 | |
| DE | 202013004798 | U1 * | 7/2013 | F41A 21/26 |
| DE | 202021102487 | U1 * | 9/2022 | |
| EP | 33700030 | B1 | 3/2020 | |

* cited by examiner

*Primary Examiner* — Reginald S Tillman, Jr.
(74) *Attorney, Agent, or Firm* — Antoinette M. Tease

(57) ABSTRACT

A bedding assembly for a rifle that includes a bedding block. The rifle has a barrel, which is attached to a receiver assembly, and the barrel has a longitudinal axis. The receiver assembly is attached to a stock by means of the bedding block. The bedding block is pivotally attached to the barrel, thereby forming an axis of pivotal attachment of the bedding block to the barrel. The axis of pivotal attachment of the bedding block to the barrel is horizontally perpendicular to and intersects the longitudinal axis of the barrel.

17 Claims, 15 Drawing Sheets

RIFLE BEDDING ASSEMBLY

CROSS-REFERENCE TO RELATED APPLICATION

Pursuant to 35 U.S.C. § 119(e), this application claims prior back to U.S. Patent Application No. 63/284,822 filed on Dec. 1, 2021.

BACKGROUND OF THE INVENTION

1. Field of the Invention

The present invention relates generally to the field of firearms and, more particularly, to a bedding block assembly for a rifle. The bedding block assembly is configured to attach the rifle barrel to the stock so as to orient the force associated with firing a bullet to be directed along the longitudinal axis of the barrel, thereby removing barrel harmonics and the recoil moment caused by the firing of the firearm.

2. Description of the Related Art

The goal of a handheld rifle design is to create a device that will guide a projectile to a specific target while being ergonomically designed in a way that affords the user the ability to carry and point the rifle at the desired target. Key features include precision, accuracy and ergonomics. Precision is the ability to point or aim the rifle repeatedly at a precise point. Accessories ranging from simple sighting devices to complex optics are designed to address this issue. Devices that aid in holding the rifle stable or steady also increase the precision of the rifle. Accuracy is the ability of the rifle to place the projectile repeatedly in the same location. Accuracy is often measured in minutes or angle variation (MOA). One MOA is approximately one inch of variation at one hundred yards. Many factors in the design of a rifle contribute to its accuracy. Variations in ammunition also affect accuracy. Accuracy is a desirable attribute of a gun because the energy of the projectile can be applied effectively only if the projectile is delivered to the intended target.

Ergonomics relates to the physical characteristics of the rifle, such as size, shape, weight and balance. Although ergonomics does not affect the accuracy of a rifle per se, it does limit the design of the rifle. For example, the design analysis may dictate that in order to increase accuracy, the barrel should weigh 20 pounds; however, this weight would not be reasonable to carry.

Inaccuracy of a firearm results primarily from angular deflection of the paths of a plurality of projectiles from the average path of the projectiles as a group, given that the aiming point is the same. In earlier times, much of this angular deflection was caused by deflection of the projectile itself after it left the gun muzzle. Poor projectile shape, as well as mass and shape eccentricity caused by fabrication technique or deformation during firing, also influenced accuracy. The addition of rifling in gun bores to impart stabilizing spin to the projectile allowed the use of improved projectile shapes. Self-contained cartridges combined with successful breech loading systems were developed. Stronger projectiles with jackets of copper or other materials resulted in greater resistance to deformation during firing. Other improvements included smoother gun bore surfaces of uniform dimensions that closely match the diameter of the projectile and better gun chamber dimensional control, resulting in close alignment of the projectile with the bore. Concentricity and uniformity in cartridges have also been greatly improved over time.

All of the above advances have reduced the angular deflection of projectiles after they depart the muzzle, but variations in angular deflection of the muzzle itself during firing is still a significant negative influence on the accuracy of firearms. Angular deflection results from the forces generated during firing. A number of factors acting in conjunction with the forces generated during firing produce effects that apply perpendicular forces to the gun bore. These factors include uneven bearing of the cartridge case on the bolt face due to cartridge or bolt irregularities, uneven bearing of bolt locking lugs on receiver mating surfaces, asymmetric flexing of the receiver under the loads of firing due to asymmetry of the receiver, and inconsistent interferences between the gun and supporting structures (including the shooter in the case of small arms and the gun carriage in the case of artillery).

The most common single factor producing force components acting perpendicularly to the gun bore (that is, applying force to the gun bore perpendicular to is longitudinal axis) results from the manner in which the barrel and receiver assembly are attached to the stock. The forces produced by the pressure of the propellant gases act rearwardly along the axis of the gun bore. The attachment of the barrel and receiver assembly to the stock transfers these forces to the stock and eventually to the shoulder of the shooter. Because the shoulder of the shooter is offset from the bore, accelerations of the gun barrel in directions perpendicular to the axis of the bore are produced. These perpendicular accelerations, which act along the unsupported sections of the gun barrel, are resisted by the mass of the gun barrel, thereby causing temporary elastic bending of the gun barrel and angular deflection of the final segment of the gun barrel proximate to its distal end (referred to as the "muzzle").

The development of these forces that produce gun muzzle angular deflection increase and diminish in very short periods of time, on the order of one millisecond for modern high-powered rifles, as the pressure inside the gun cartridge increases to a peak and then declines as the projectile moves further down the barrel and is finally released as it leaves the muzzle. The bending of the gun barrel is, therefore, also a transient event resulting in changes in the amount of bending over the very short time period while the projectile is in the barrel. Small variables, which may include such things as changes in the pressure profile and/or drag of the projectile inside the barrel from shot to shot, tend to change the timing of the projectile departure relative to the angular position of the muzzle. This in turn results in dispersion of projectile impacts at the target.

Conventional methods of dealing with this problem involve two primary techniques for mitigating the negative effects of angular deflection in the muzzle of a gun during firing. The first technique consists of increasing the section modulus of gun barrels, thereby reducing the magnitude of deflection under perpendicular accelerations. This is usually achieved by simply increasing the outer diameter of the gun barrel, although fluted or sleeved barrels are sometimes used. The second technique consists of adding a small fixed or adjustable weight to the end of the barrel and placing the weight in a position to cause of a period of reduced rate of angular deflection at the muzzle to coincide with the average time of projectile exit. Both of these techniques have limitations. Fluted and sleeved barrels are usually heavier than their standard counterparts of the same length. Larger diameter barrels are always heavier. Barrel weights can only be correctly positioned or "tuned" empirically and also typically perform best with only one cartridge loading condition. Retuning is required for any change in cartridge or cartridge components, including changes in brand, bullet type, weight, or powder charge. Furthermore, both of these techniques can only reduce, but not eliminate, angular deflection of gun muzzles. Because some variation in the timing of projectile release will always exist, these techniques cannot fully optimize the accuracy of firearms.

Although many factors determine accuracy, barrel harmonics is a phenomenon that plagues most rifles. When a rifle is fired, a shock wave is introduced into the barrel. This causes the barrel to vibrate, in a manner similar to that of a tuning fork hit by a hammer. This vibration causes a slight change in curvature of the barrel, which oscillates for a short period of time. The trajectory path of the projectile is changed, depending on the timing of exit of the projectile from the muzzle. To counter this effect, barrel and receiver assemblies have been increased in size in order to add stiffness and reduce the amplitude of the vibrations; however, this increase in size adds undesirable weight. Some barrels use materials such as carbon fiber composite layers to add stiffness without adding weight. Barrel weights and muzzle brakes have been added to change the frequency of the vibration. Some of these devices are adjustable in order to tune the vibration frequency to an optimal point for certain types of ammunition. Hand loading ammunition to a specific velocity (that is, selecting the optimal bullet weight and design) is another way of tuning the ammunition to match the barrel frequency. These methods, however, only minimize the effect of the vibration and do not address its root cause; in other words, they do not eliminate vibration of the gun barrel.

It is an object of the present invention to provide a bedding device for a rifle that will eliminate vibration of the gun barrel by aligning the resistive force created by the bedding block with the longitudinal axis of the barrel. In the past, barrel placement with respect to the attachment means has largely been dictated by ergonomics. In order to sight the rifle at the target, the barrel axis is raised toward the line of sight of the shooter. Recoil or reaction force is absorbed by the shoulder of the shooter. Because the shoulder is lower than the eye, the stock is generally lower than the barrel. This type of configuration causes an "annular wave" or "pressure pulse" (also referred to as a "moment" or "moment load") in the barrel when the rifle is fired, if a means of attachment could hold the barrel above the stock but not put a moment load into the barrel assembly, then the rifle could be both ergonomically practical and free from barrel vibration. It is a further object of the present invention to provide a device that can stop rearward motion of the barrel assembly of a rifle by applying pressure in line with the barrel axis, thereby eliminating the torque caused by recoil.

BRIEF SUMMARY OF THE INVENTION

The present invention is a bedding assembly for a rifle comprising: a bedding block; and a bedding bushing; wherein the rifle has a barrel, and the barrel has a longitudinal axis; wherein the bedding block and bedding bushing each has a central bore; wherein the central bore of the bedding block and the central bore of the bedding bushing each has a longitudinal axis; wherein the longitudinal axis of the bedding block and the longitudinal axis of the bedding bushing are aligned with each other to form a common longitudinal axis; wherein the common longitudinal axis formed by the bedding block and the bedding bushing is aligned with the longitudinal axis of the barrel; wherein the bedding block comprises an annular ring and two opposing lobes that extend forwardly from a front end of the annular ring; wherein each lobe has a curved surface that extends outwardly from the front end of the annular ring; wherein the bedding bushing is comprised of an outer annular ring and an inner annular ring, the outer annular ring being situated forwardly of the inner annular ring; wherein the outer annular ring of the bedding bushing has an outer diameter, the inner annular ring of the bedding bushing has an outer diameter, and the outer diameter of the outer annular ring is greater than the outer diameter of the inner annular ring; wherein the inner annular ring of the bedding bushing is configured to fit within the annular ring of the bedding block; wherein the outer annular ring of the bedding bushing comprises two cutouts that are configured to receive the two opposing lobes of the bedding block; wherein the annular ring of the bedding block comprises an interior surface, and the interior surface of the annular ring comprises two opposing longitudinal strips; and wherein the barrel comprises a breech end, and both the bedding block and the bedding bushing are configured to receive the breech end of the barrel.

In a preferred embodiment, the present invention further comprises a wave spring; wherein the bedding block comprises a rear circumferential groove that is configured to receive the wave spring. Preferably, each lobe is in the form of a semi-circle. The annular ring of the bedding block preferably has an interior curvature; wherein each lobe has an interior surface; and wherein the interior surface of each lobe is concave to match the interior curvature of the annular ring of the bedding block.

In a preferred embodiment, the bedding block and the two opposing lobes are a single machined part. Preferably, the rifle comprises a stock; and the bedding block further comprises a mounting bracket that is configured to attach the bedding block to the stock. The outer annular ring of the bedding block and the inner annular ring of the bedding bushing are preferably a single machined part.

In a preferred embodiment, the outer annular ring of the bedding bushing has a front edge; and the front edge of the bedding bushing is beveled. Preferably, the annular ring of the bedding block comprises a front edge; wherein the outer annular ring of the bedding bushing comprises a rear circumferential edge; and wherein the bedding block and the bedding bushing are configured so that the rear circumferential edge of the outer annular ring of the bedding bushing faces but does not come into contact with the front edge of the annular ring of the bedding block so as to create a first gap between the front edge of the annular ring of the bedding block and the rear circumferential edge of the bedding bushing. The rifle preferably comprises a receiver; wherein the bedding block comprises a rear surface; wherein the inner annular ring of the bedding bushing is longer than the annular ring of the bedding block, thereby creating a second gap between the rear surface of the bedding block and a front end of the receiver; wherein the inner annular ring of the bedding bushing comprises a rear face; and wherein the rear face of the inner annular ring of the bedding bushing is configured to abut up against the front end of the receiver.

In a preferred embodiment, each of the flat longitudinal strips extends from a rear edge of the annular ring of the bedding block to a front edge of one of the two opposing lobes. Preferably, each of the flat longitudinal strips is parallel with a longitudinal center of the annular ring of the bedding block and parallel with the longitudinal axis of the barrel; wherein each of the two flat longitudinal strips has a central longitudinal axis; and wherein the flat longitudinal strips are configured so that a line drawn between the central longitudinal axis of each of the flat longitudinal strips would intersect the longitudinal axis of the barrel. The annular ring of the bedding block preferably has a vertical inner diameter and a horizontal inner diameter; and the vertical inner diameter of the bedding block is greater than the horizontal inner diameter of the bedding block.

In a preferred embodiment, the inner annular ring of the bedding bushing has an outer diameter; and the horizontal inner diameter of the annular ring of the bedding block is approximately equal to the outer diameter of the inner annular ring of the bedding bushing. Preferably, the bedding bushing is symmetrical from top-to-bottom and from right-to-left. The bedding bushing preferably has a constant inner diameter.

The present invention is also a bedding assembly for a rifle comprising a bedding block; wherein the rifle comprises a barrel, and the barrel is attached to a receiver assembly; wherein the barrel has a longitudinal axis; wherein the receiver assembly is attached to a stock by means of the bedding block; wherein the bedding block is pivotally attached to the barrel, thereby forming an axis of pivotal attachment of the bedding block to the barrel; and wherein the axis of pivotal attachment of the bedding block to the barrel is horizontally perpendicular to and intersects the longitudinal axis of the barrel.

REFERENCE NUMBERS

Figure 1:
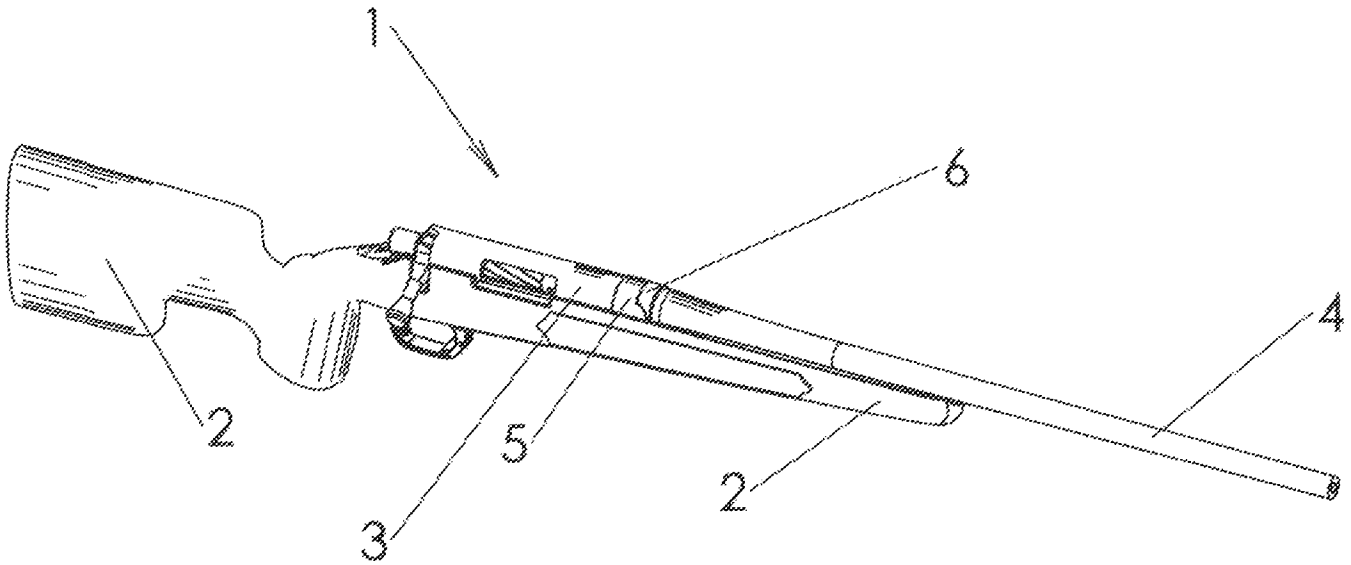
FIG. 1 is a perspective view of the rifle bedding assembly of the present invention incorporated into a rifle.

1 Rifle
2 Stock
3 Receiver
4 Barrel
4*a* Central bore
5 Bedding block
5*a* Annular ring
5*b* Lobe
5*c* Mounting bracket
6 Bedding bushing
6*a* Outer annular ring
6*b* inner annular ring
6*c* Cutout
7 Rifle bedding assembly
8 Wave spring
9 Circumferential groove
10 Screw

DETAILED DESCRIPTION OF INVENTION

A. Overview

The disadvantages of the prior art discussed above are overcome by the present invention, which changes the way in which the barrel and receiver are mounted on the stock so that the recoil moment (caused by the firing of the gun) and barrel harmonics are eliminated. The present invention is a device that is specifically designed to attach the barrel of a rifle to the stock so that the force associated with firing a bullet is directed along the longitudinal axis of the barrel and the high-stress areas of the receiver and barrel are symmetric about the bore longitudinal axis. This device incorporates a front pivotal attachment mechanism that is in-line with the force generated by the firing of the firearm.

The present invention, which is described more fully below, ensures that no impact moment is generated during the shot and no vibration is introduced into the barrel. As a result, there is no need for extra material to be added to the barrel and receiver to increase stiffness. The present invention also eliminates the need to tune the receiver/barrel to a certain ammunition type. The present invention can be used with different ammunition brands, bullet weight and velocity with virtually no effect on the bullet point of impact.

Because the present invention eliminates barrel vibration, the improved rifle has greater accuracy without having greater weight. The present invention allows for a light-weight rifle design that has superior accuracy as compared to conventional rifle systems. The improved rifle design may be used with various ammunition specifications to the same point of impact.

B. Detail Description of the Figures

FIG. 1 is a perspective view of the rifle bedding assembly of the present invention incorporated into a rifle. This figure shows various parts of the rifle 1, namely, the stock 2, receiver 3 and barrel 4. It also shows the bedding block 5 and bedding bushing 6, which are parts of the present invention. As shown in this figure, the bedding block 5 and bedding bushing 6 are situated between the barrel 4 and receiver 3. The barrel 4 has a longitudinal axis (through the central bore 4*a* in the barrel), and the bedding block 5 and bedding bushing 6 are aligned with the longitudinal axis of the barrel 4. The present invention is a bedding block assembly for a rifle. The particular type of rifle shown in the figures is a Remington Model 700™; however, the present invention is not limited to any particular make or model of rifle. The present invention may be retrofit to an existing rifle or may be incorporated into the rifle by an original equipment manufacturer. Any rifle parts as shown in the figures other than the bedding block assembly are provided for environment only and should not be construed as part of the present invention.

Figure 2:
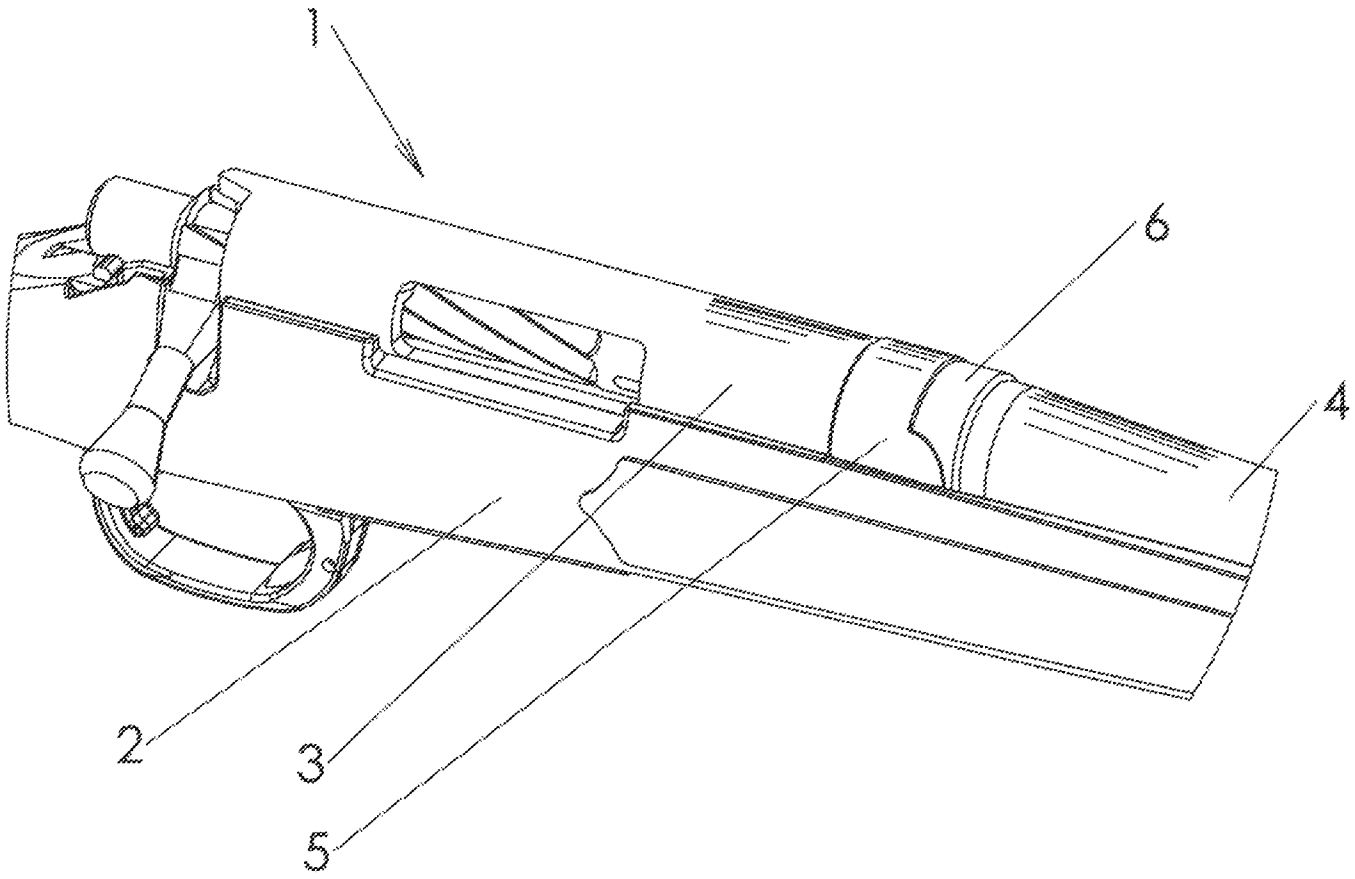
FIG. 2 is a detail perspective view of the rifle bedding assembly shown in FIG. 1 as installed on a rifle.

FIG. 2 is a detail perspective view of the rifle bedding assembly shown in FIG. 1 as installed on a rifle. This figure provides a closer view of the rifle bedding assembly 7, which includes the bedding block 5, the bedding bushing 6, and an optional wave spring 8 (see FIG. 3). The structure of the bedding block 5 and the bedding bushing 6 is shown more clearly in subsequent figures.

Figure 3:
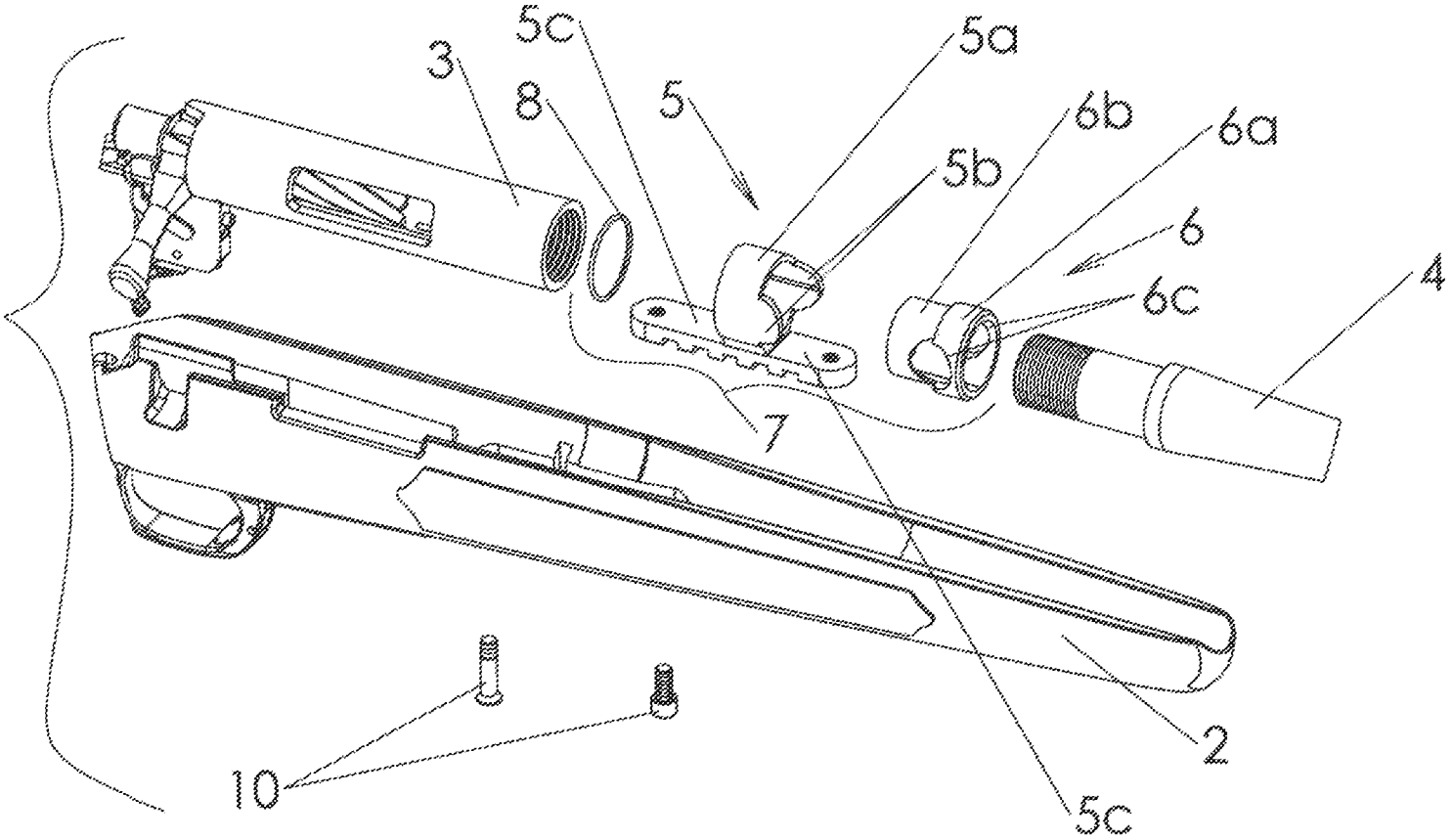
FIG. 3 is an exploded view of the parts shown in FIG. 2.

FIG. 3 is an exploded view of the parts shown in FIG. 2. This figure shows the receiver 3, which is situated at one end of the rifle bedding assembly 7, and the barrel 4, which is situated at the other end of the bedding assembly 7. As noted above, the rifle bedding assembly 7 is comprised of the bedding block 5, the bedding bushing 6, and the optional wave spring 8. The wave spring 8 fits into a circumferential groove 9 on the rear end of the bedding block 5 (see FIG. 14). When the bedding assembly 7 is installed on a rifle, the wave spring 8 provides tension between the front end of the receiver 3 and the rear end of the bedding block 5, thereby ensuring a tight fit between the bedding block 5 and the bedding bushing 6.

The bedding block 5 is comprised of an annular ring 5*a* and two lobes 5*b* that extend forwardly from the front end of the annular ring 5*a*. The lobes 5*b* are positioned directly opposite one another in the center of the right and left sides of the annular ring 5*a*. In this manner, a line drawn between the center point of each of the two lobes would intersect and be perpendicular to the longitudinal axis of the barrel (see b on FIG. 13). Each lobe 5*b* has a curved surface that extends outwardly (and forwardly) from the front end of the annular ring 5*a*, as noted above. (The lobes and cutouts would not be able to act as a hinge if the lobe did not have a curved or rounded surface, which enables the lobe to rotate or turn within the cutout.) In a preferred embodiment, each lobe 5*b* is in the shape of a semi-circle. In addition, the interior surface of each lobe is concave to match the interior curvature of the annular ring 5*a*. In a preferred embodiment, the annular ring 5*a* and the two lobes 5*b* are a single machined part.

Figure 15:
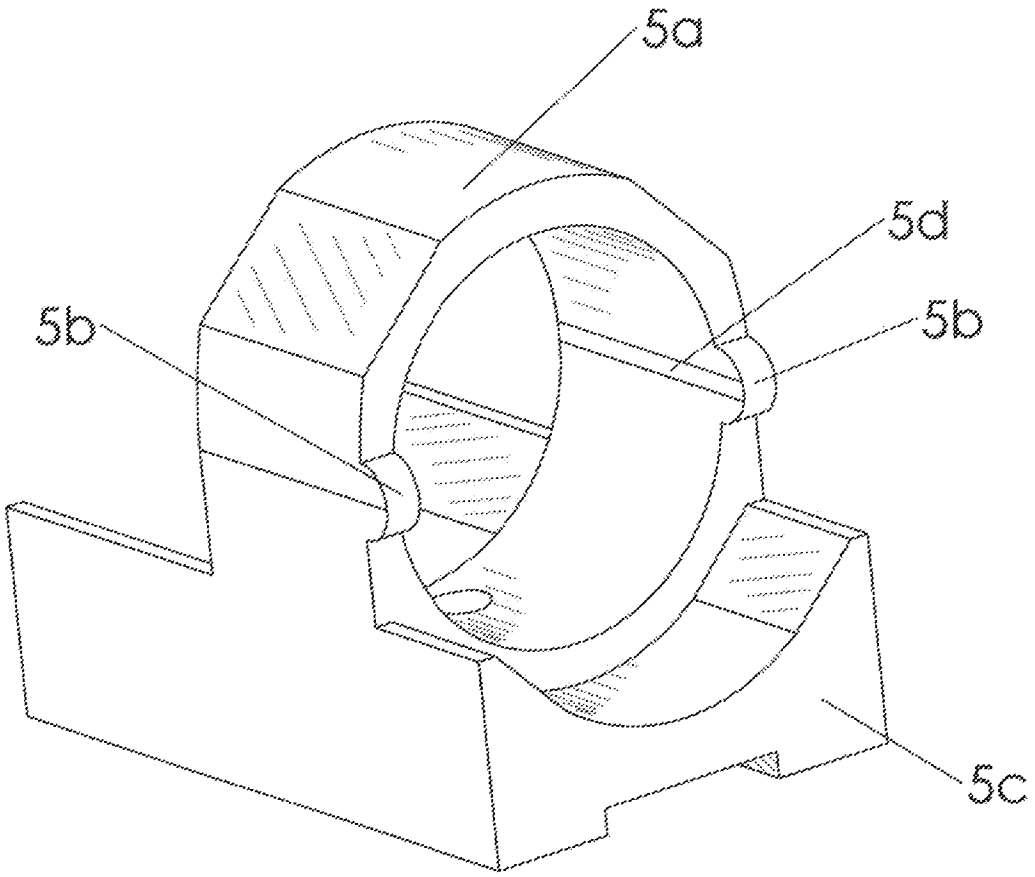
FIG. 15 is a perspective view of an alternate embodiment of the bedding block of the present invention.

The annular ring 5*a* of the bedding block 5 is situated on top of a mounting bracket 5*c*. The present invention is not limited to any particular form of the mounting bracket Sc. The purpose of the mounting bracket 5*c* is to enable the bedding block 5 to be secured to the stock 2. An alternate form of the mounting bracket Sc is shown in FIG. 15. In the embodiment shown in FIG. 3, the mounting bracket Sc is secured to the stock 2 with screws 10 (see also FIG. 4).

The bedding bushing 6 is comprised of two parts, both of which are in the form of an annular ring, with the outer annular ring 6*a* situated forwardly of the inner annular ring 6*b*. In a preferred embodiment, the outer annular ring 6*a* and the inner annular ring 6*b* are machined together as a single part. In a preferred embodiment, the front edge of the outer annular ring 6*a* is preferably beveled so as to avoid exposing the operator to sharp edges. The bedding block 5 and the bedding bushing 6 are both configured to receive the breech end of the barrel 4. In fact, the breech end of the barrel 4, which is threaded, as shown, passes through the center of the bushing block 6 and the center of the bedding barrel 5 and threads into the front end of the receiver 3.

The bedding bushing preferably has a constant inner diameter (in other words, the inner diameter of the outer annular ring 6*a* and the inner diameter of the inner annular ring 6*b* are the same) but two different outer diameters. Specifically, the outer diameter of the outer annular ring 6*a* is greater than the outer diameter of the inner annular ring 6*b*. The inner annular ring 6*b* is configured to fit within the annular ring 50 of the bedding block 5. The outer diameter of the outer annular ring 6*a* of the bedding bushing 6 is preferably slightly less than the outer diameter of the annular ring 5*a* of the bedding block 5 (see FIG. 3). The bedding block assembly 7 is configured so that when the bedding bushing 6 is installed on the bedding block 5, the rear circumferential edge of the outer annular ring 6*a* (marked as "x" in FIG. 4) faces but does not come into contact with the front edge of the annular ring 5*a* of the bedding block 5 (marked as "y" in FIG. 4). In other words, there is a first gap (marked as "z" in FIG. 8) between these two surfaces. The outer annular ring 6*a* of the bedding bushing 6 comprises two cutouts 6*c* that are configured to receive the lobes 5*b* of the bedding block 5.

Figure 4:
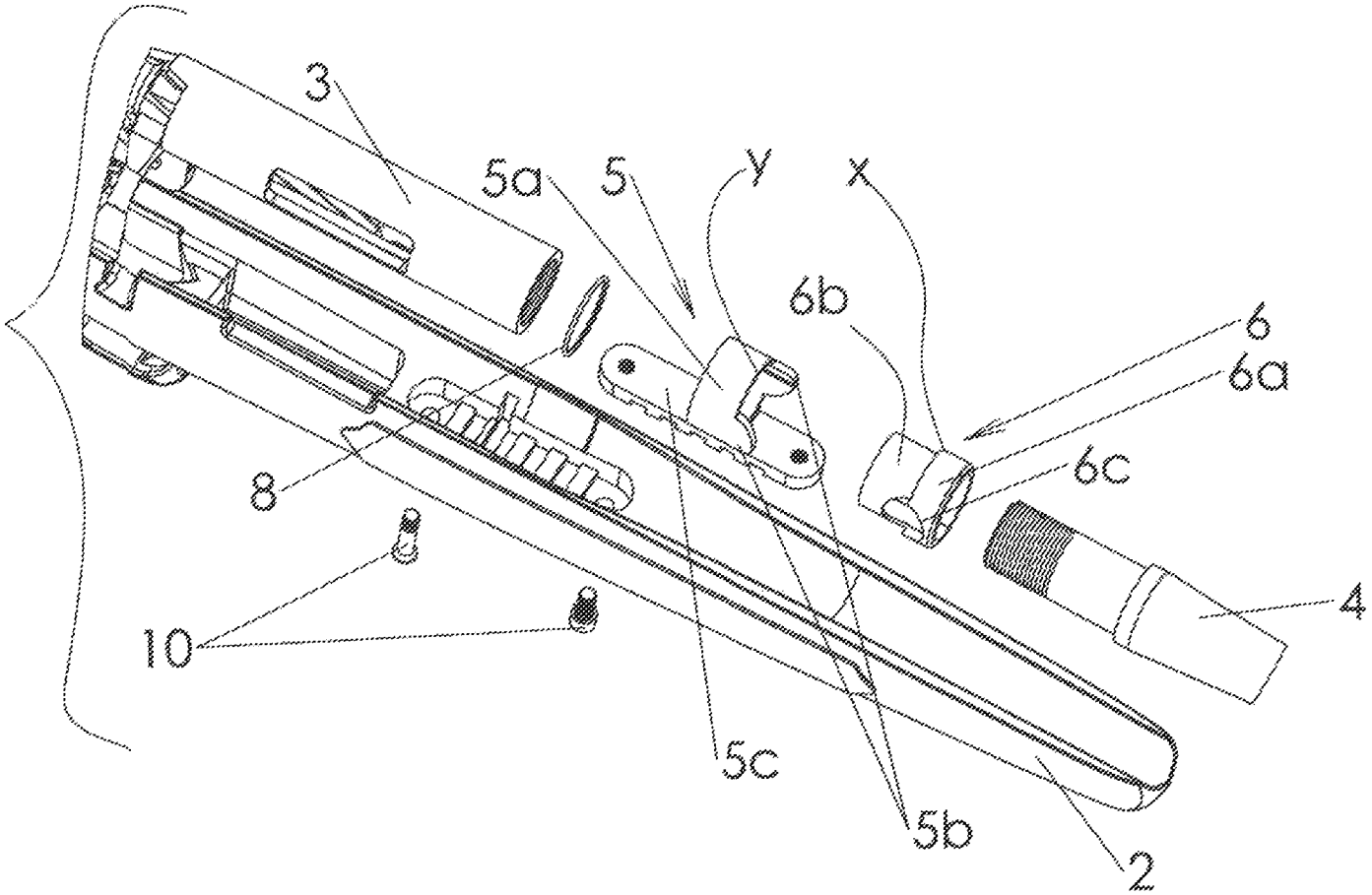
FIG. 4 is a top perspective exploded view of the same parts that are shown in FIG. 3.

FIG. 4 is a top perspective exploded view of the same parts that are shown in FIG. 3. As shown in this and the preceding figure, the inner annular ring 6*b* of the bedding bushing 6 may also have cutouts (similar to the cutouts 6*c* in the outer annular ring 6*a*), but these cutouts have no functional purpose and are not a necessary part of the invention; they are shown here for ease of manufacturing.

Figure 5:
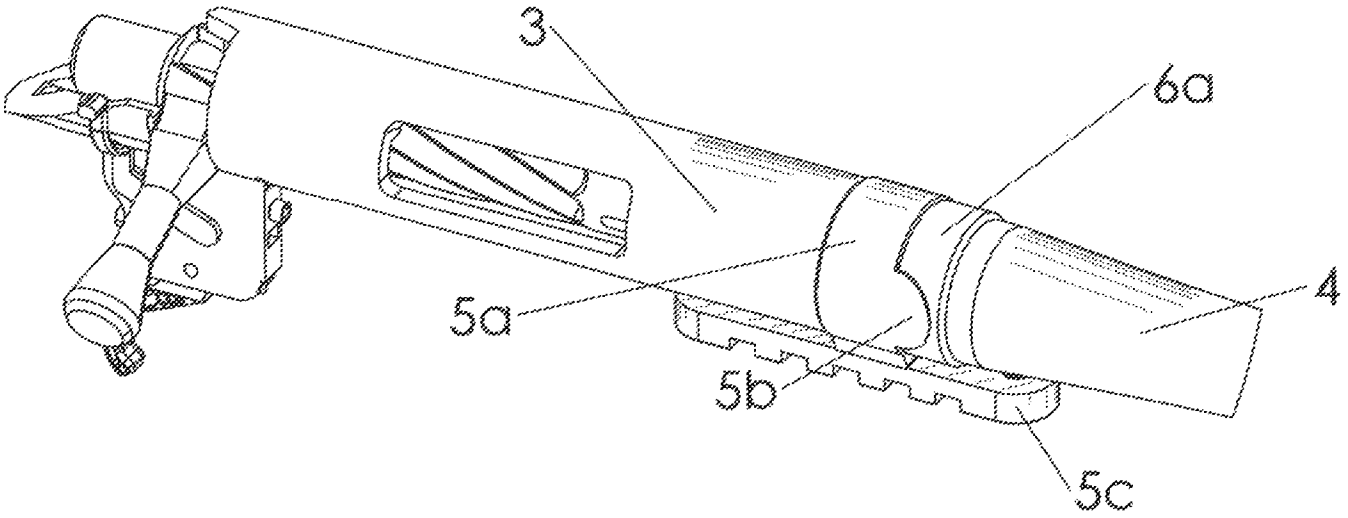
FIG. 5 is the same view shown in FIG. 2 with the stock, trigger guard (also referred to as the "bottom metal"), floor plate and magazine release omitted.

FIG. 5 is the same view shown in FIG. 2 with the stock, trigger guard (also referred to as the "bottom metal"), floor plate and magazine release omitted. This figure shows the bedding block 5 and bedding bushing 6 installed on a rifle. Note that the tapered part of the barrel 4 begins only after the barrel exits the bedding bushing 6; that part of the barrel 4 that extends through the center of the bedding block 5 and the bedding bushing 6 has a constant outer diameter. Just as the outer diameter of the annular ring 5*a* of the bedding block 5 is slightly greater than the outer diameter of the outer annular ring 6*a* of the bedding bushing 6, the outer diameter of the annular ring 5*a* of the bedding block 5 is slightly greater than the outer diameter of the receiver 3. This is shown more clearly in FIG. 8.

Figure 6:
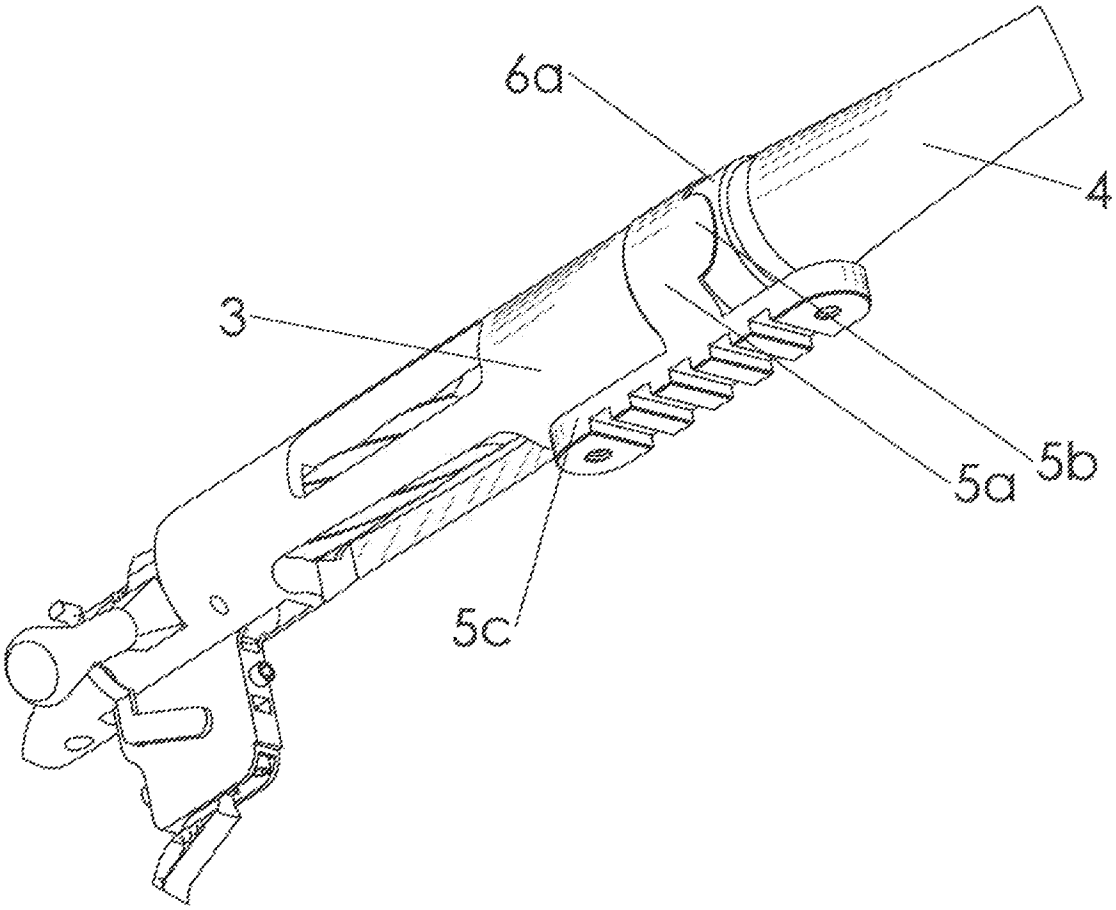
FIG. 6 is a bottom perspective view of the same parts in the same configuration as shown in FIG. 5.

FIG. 6 is a bottom perspective view of the same parts in the same configuration as shown in FIG. 5. This figure shows the underside of the mounting bracket Sc, which in this case comprises teeth that are designed to engage with a platform in the interior of the stock (see FIG. 4). As noted above, in this embodiment, the mounting bracket Sc is secured to the stock with screws 10. The present invention is not limited to any particular form of mounting bracket 5*c*, or any particular method of securing the mounting bracket to the stock, as long as the mounting bracket is sufficiently substantial in size to handle some of the moment load and configured to prevent the bedding block 5 from shearing off backwards during firing.

Figure 7:
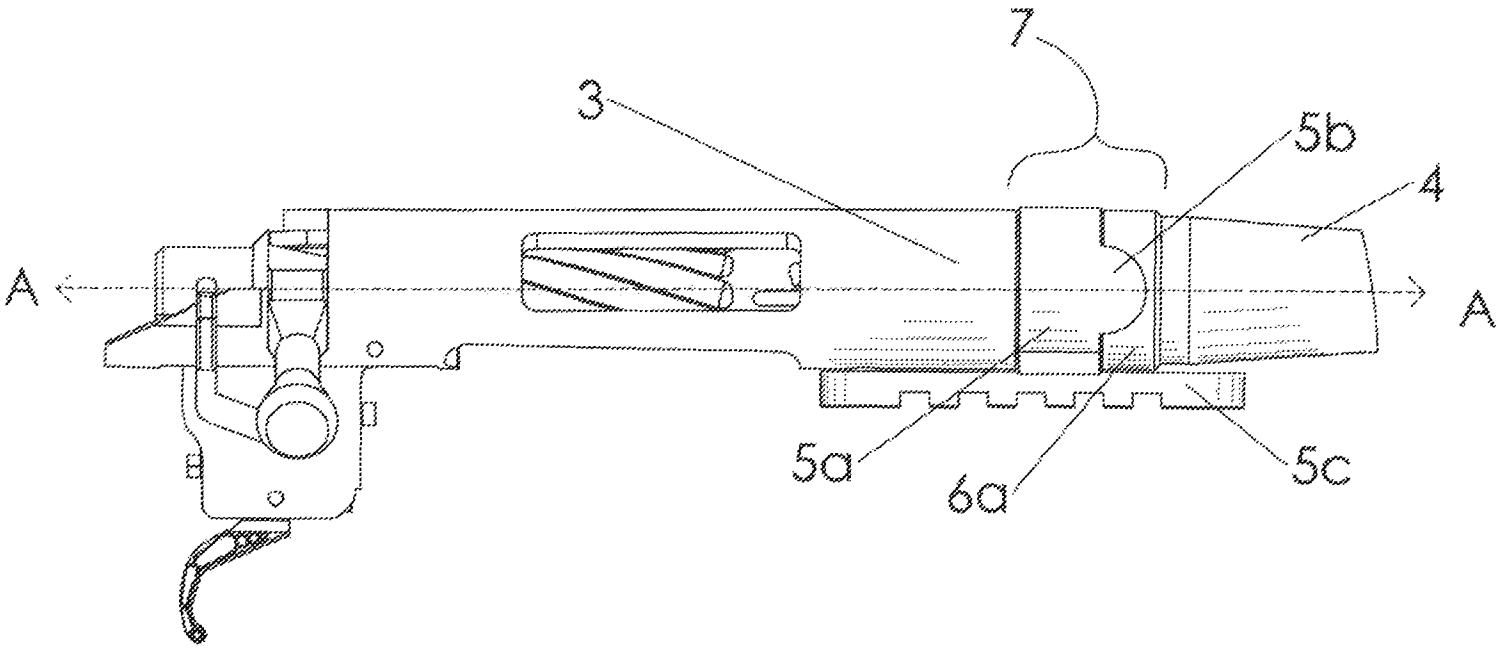
FIG. 7 is a side view of the same parts in the same configuration as shown in FIGS. 5 and 6.

FIG. 7 is a side view of the same parts in the same configuration as shown in FIGS. 5 and 6. As shown in this figure, each lobe 5*b* of the bedding block 5 extends forwardly from the front surface of the bedding block and is inserted into a cutout 16*c* in the outer annular ring 6*a* of the bedding bushing 6. This figure also shows the front beveled edge of the outer annular ring 6*a*. When the bedding block assembly 7 of the present invention is installed on a rifle, the longitudinal axis of the barrel 4 is aligned with the central axis of the bedding bushing 6, the bedding block 5, and the receiver 2. This common axis is designated as "A" in FIG. 7.

Figure 8:
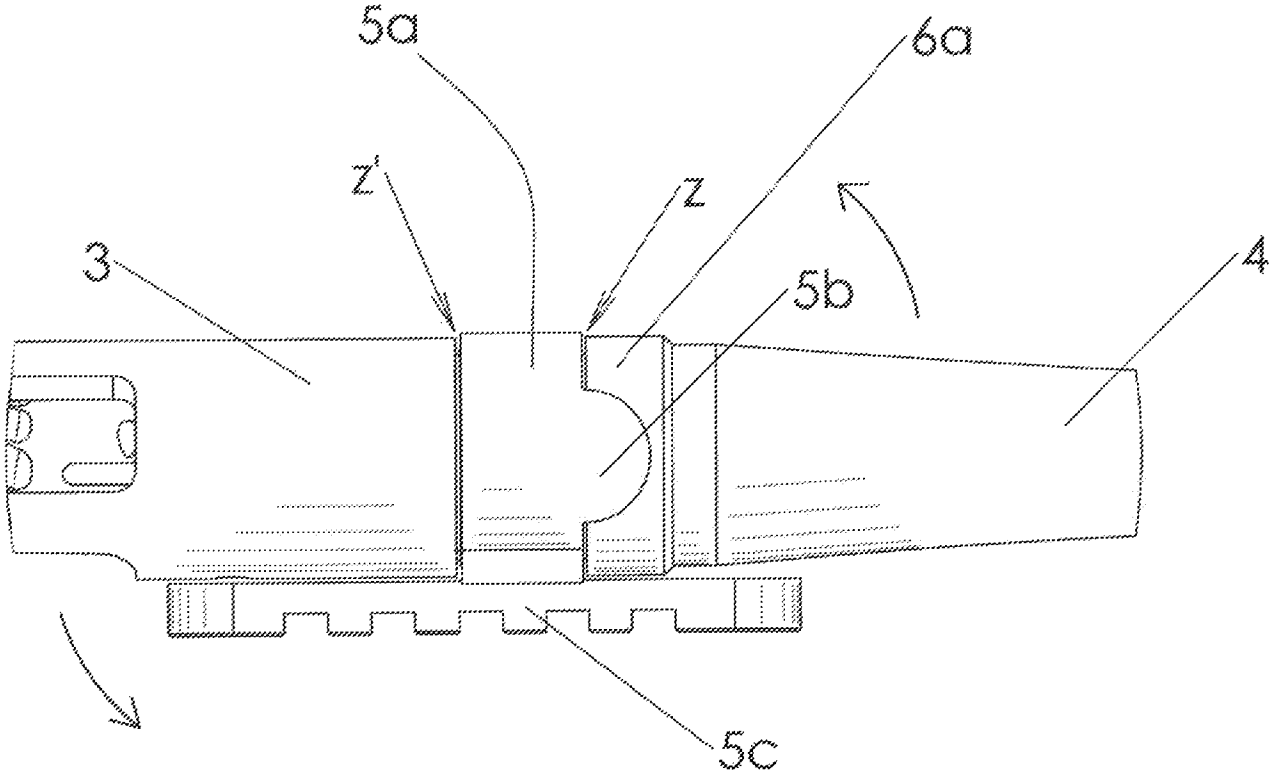
FIG. 8 is a side detail view of the bedding block and bedding bushing of the present invention shown in relation to the rifle barrel and receiver.

FIG. 8 is a side detail view of the bedding block and bedding bushing of the present invention shown in relation to the rifle barrel and receiver. The purpose of this figure is to illustrate the movement in the barrel 4 upon firing. When the rifle is fired, the barrel and receiver (which are fixedly attached to each other) are prevented from moving laterally (that is, right to left) by virtue of the bands on the inside of the bedding block 6 (these bands are discussed more fully in connection with FIG. 12 below). As the barrel and receiver tilt upward, the top of the first gap z closes (while the bottom of this same gap opens), and the top of the second gap (labeled as z' in FIG. 8) opens (while the bottom of this same gap closes). As the barrel and receiver tilt downward, the bottom of the first gap z closes (while the top of this same gap opens), and the bottom of the second gap Z opens (while the top of this same gap closes).

In other words, the present invention is designed so that there is not only a first gap x between the rear surface of the outer annular ring 6*a* of the bedding bushing 6 but also a second gap z' between the rear surface of the bedding block 5 and the front end of the receiver 2. Both the first and second gaps are created by virtue of the fact that the inner annular ring 6*b* of the bedding bushing 6, which extends through the bedding block 5, is longer (measuring front to back, or along the longitudinal axis of the rifle) than the annular ring 5*a* of the bedding block 5. These gaps enable the barrel to tilt or rotate vertically (upward or downward) while at the same time the barrel is prevented from moving laterally. As a result of this configuration, the recoil load is absorbed entirely along the central axis of the barrel (that is, the common axis A).

Figure 9:
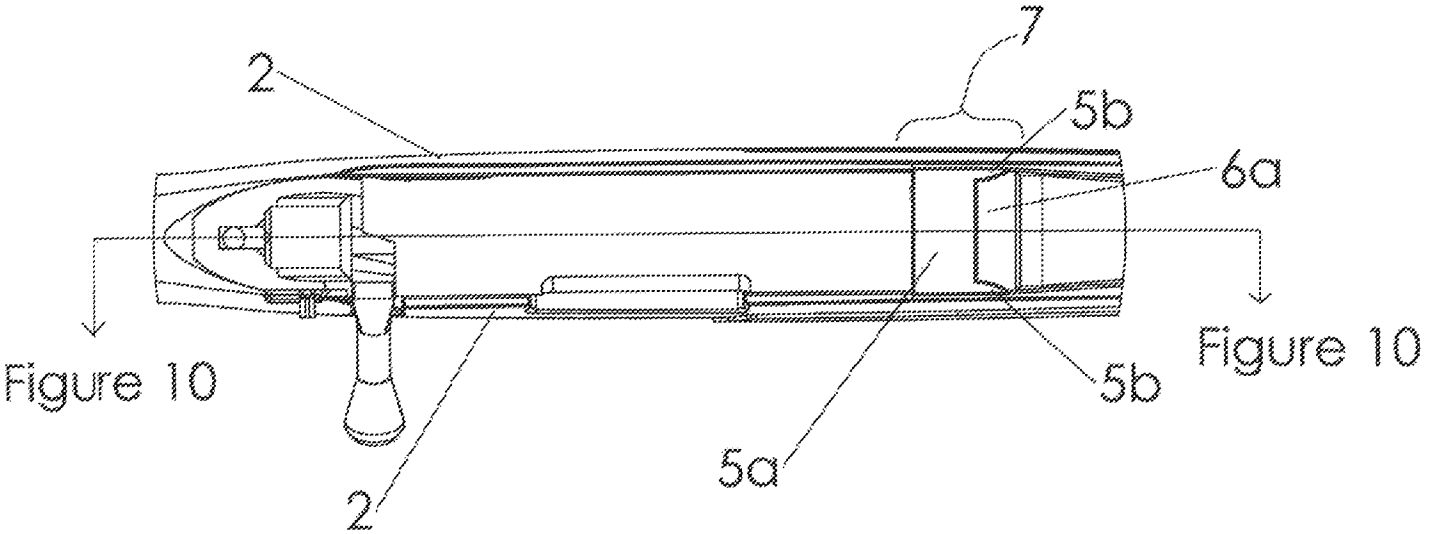
FIG. 9 is a top detail view of the parts shown in FIG. 2.

FIG. 9 is a top detail view of the parts shown in FIG. 2. The purpose of this figure is simply to provide a reference for the section view shown in FIG. 10.

Figure 10:
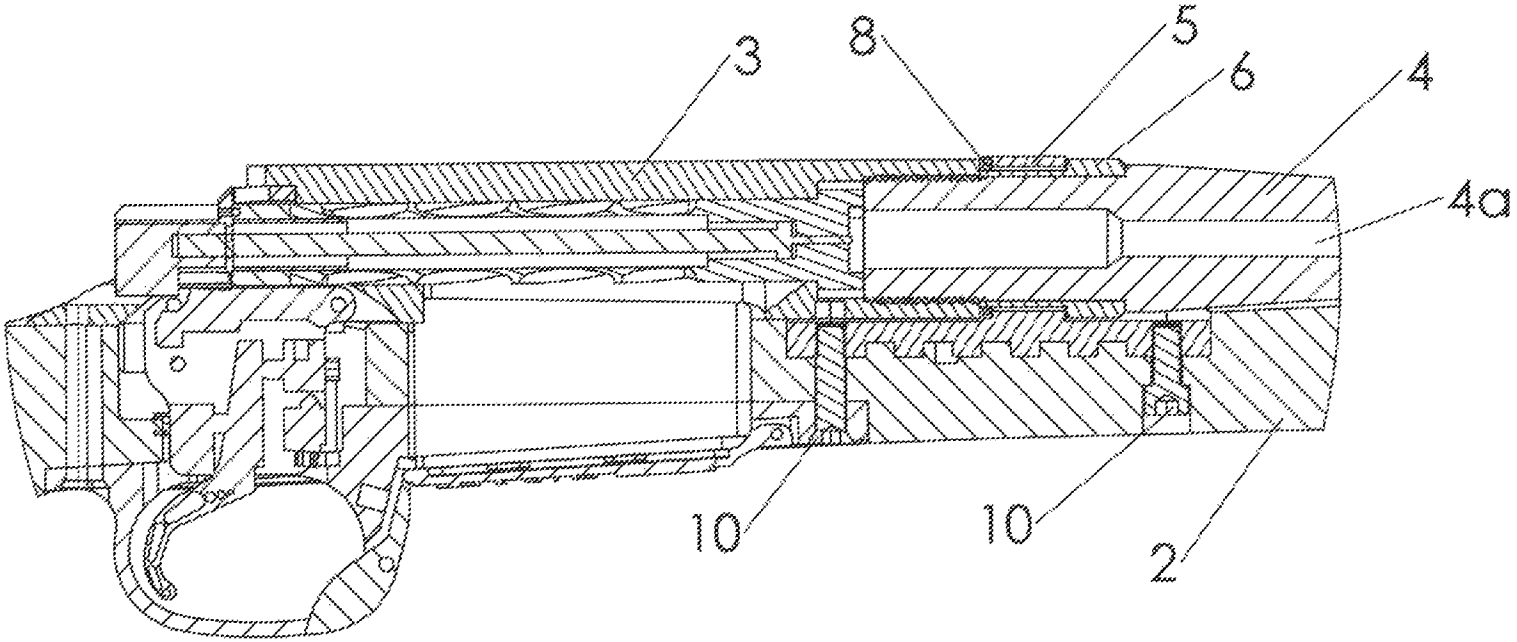
FIG. 10 is a section view taken at the line shown in FIG. 9.

FIG. 10 is a section view taken at the line shown in FIG. 9. As shown in this figure, the axis of the central bore 4*a* that extends longitudinally through the center of the barrel 4 is aligned not only with the firing pin but also with the central axis of the bedding bushing 5 and bedding block 6. With lateral movement of the barrel 4 constrained, as described more fully below, the barrel 4 can only move upwardly or downwardly upon firing, thereby preventing the random barrel vibrations that are associated with conventional rifle bedding systems. By virtue of the unique structure of the bedding block 5 and bedding bushing 6, which act together as a hinge, the present invention constrains lateral (sideways) movement of the barrel while leaving limited clearance for the barrel to tilt or rotate vertically on hinge created by the coupling of the barrel block 5 with the barrel bushing 6.

Figure 11:
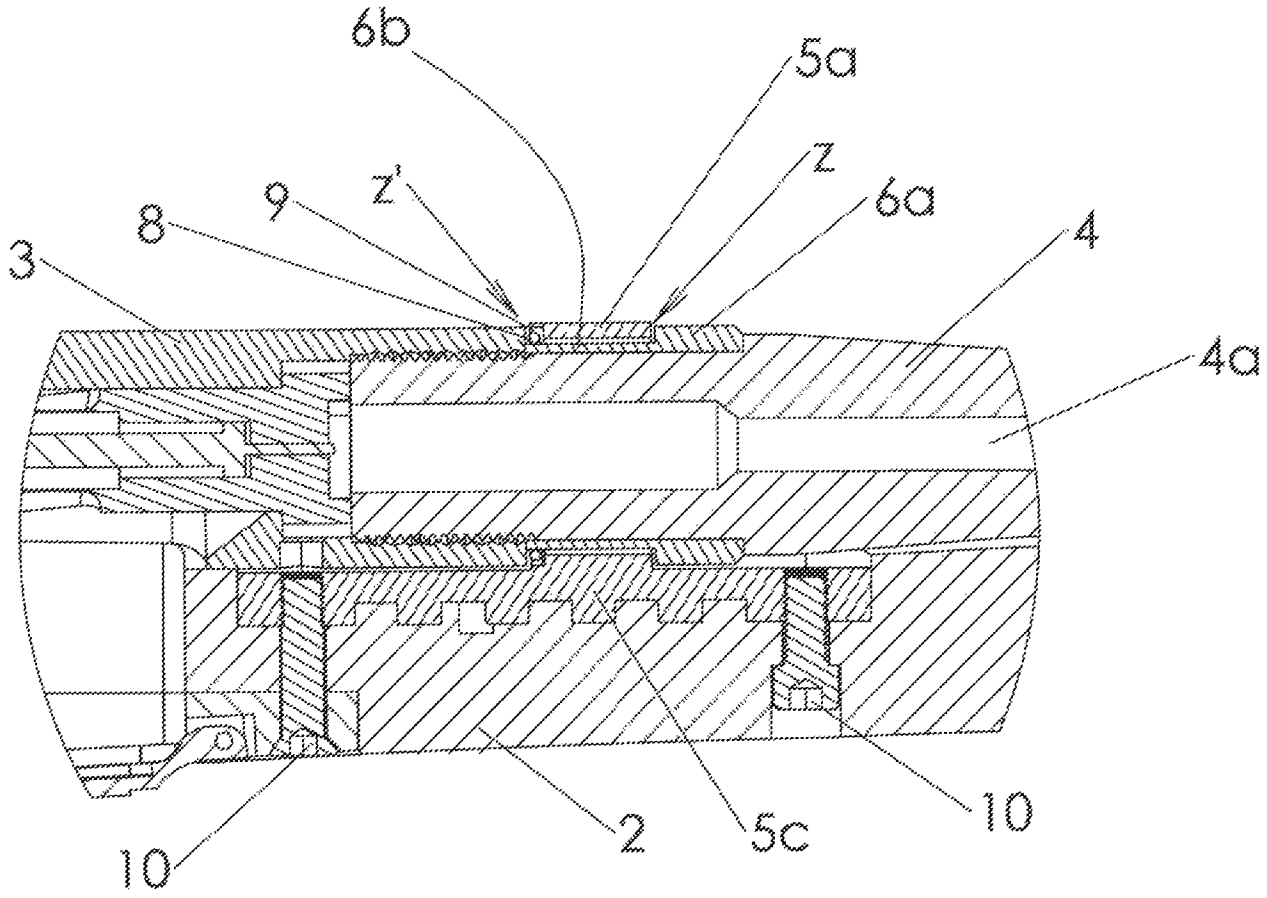
FIG. 11 is a detail section view of the rifle bedding assembly of the present invention as shown in FIG. 10.

FIG. 11 is a detail section view of the rifle bedding assembly of the present invention as shown in FIG. 10. This figure shows the wave spring 8, which is situated inside of the circumferential groove 9 in the bedding block 6. Because this figure is a side view, the lobes 6*b* are not visible in this figure. This figure shows the threads at the front end of the receiver 3 with which the breech end of the barrel 4 is threadably coupled. This figure also illustrates the fact, noted above, that the inner annular ring 6*b* of the bedding bushing 6 is longer (longitudinally or from front to back) than the annular ring 5*a* of the bedding block 5. In fact, the rear face of the inner annular ring 6*b* abuts up against the front face of the receiver 3, as shown, thereby creating the second gap z'. The length of the inner annular ring 6*b* is set so as to create both the first z and second z' gaps. As shown here, the entire bedding bushing 6 fits solidly against the barrel (front end of bushing) and the receiver (rear end of bushing); as such, the bedding bushing 6 moves with the barrel and receiver when they rotate or tilt vertically upward or downward upon firing, and the bedding bushing 6 rotates on the hinge create by the lobes 5*b* and cutouts 6*c*. By contrast, because the bedding block 5 is secured to the stock 2 via the mounting bracket Sc, it does not move upon firing.

Figure 12:
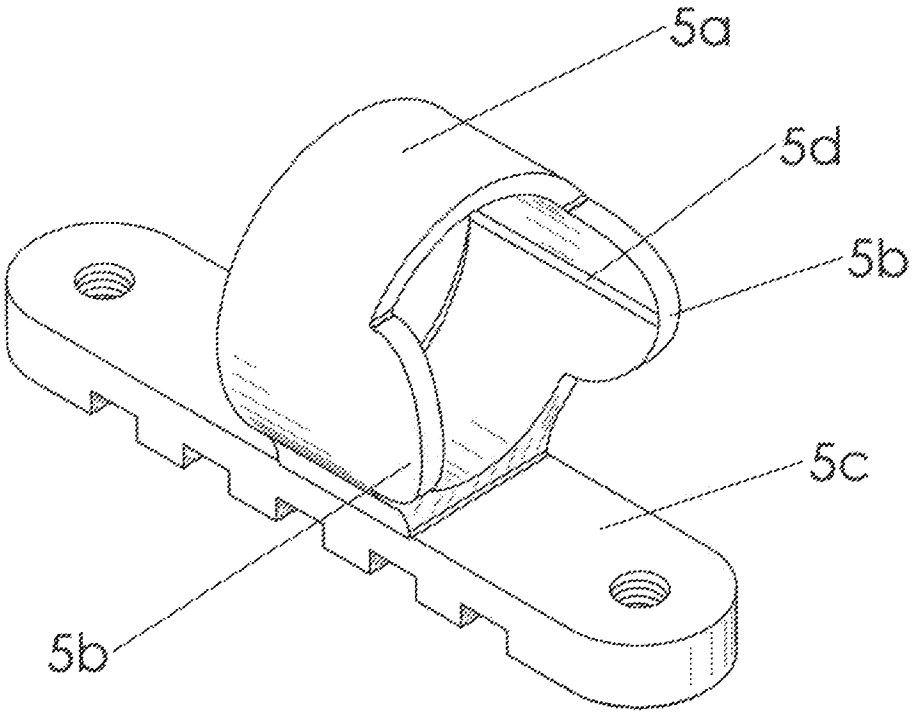
FIG. 12 is a top front perspective view of the bedding block of the present invention.

FIG. 12 is a top front perspective view of the bedding block of the present invention. As shown in this figure, the interior surface of the annular ring 5*a* of the bedding block 5 comprises opposing longitudinal strips 5*d* that are not concave like the rest of the inner surface of the annular ring 5*a*. Instead, these strips 5*d* are flat, and they extend from the rear edge of the annular ring 5*a* to the front edge of each lobe 5*b*. The strips 5*d* are parallel with the longitudinal center of the annular ring 5; therefore, they are also parallel to the longitudinal axis of the central bore 4*a* of the barrel 4. Because these strips 5*d* are flat and not concave, they exert pressure on the lateral sides of the barrel 4 when it is inserted through the bedding block 5; in other words, the strips 5*d* "hug" the barrel on either side of the barrel, thereby preventing it from moving right to left upon firing. The bedding block 5 and strips 5*d* are configured so that each strip (a) is parallel with (and on the same horizontal plane as) the longitudinal axis of the central bore 4*a* of the barrel 4 and (b) tightly grips the barrel 4 along the entire length of the strip.

Figure 13:
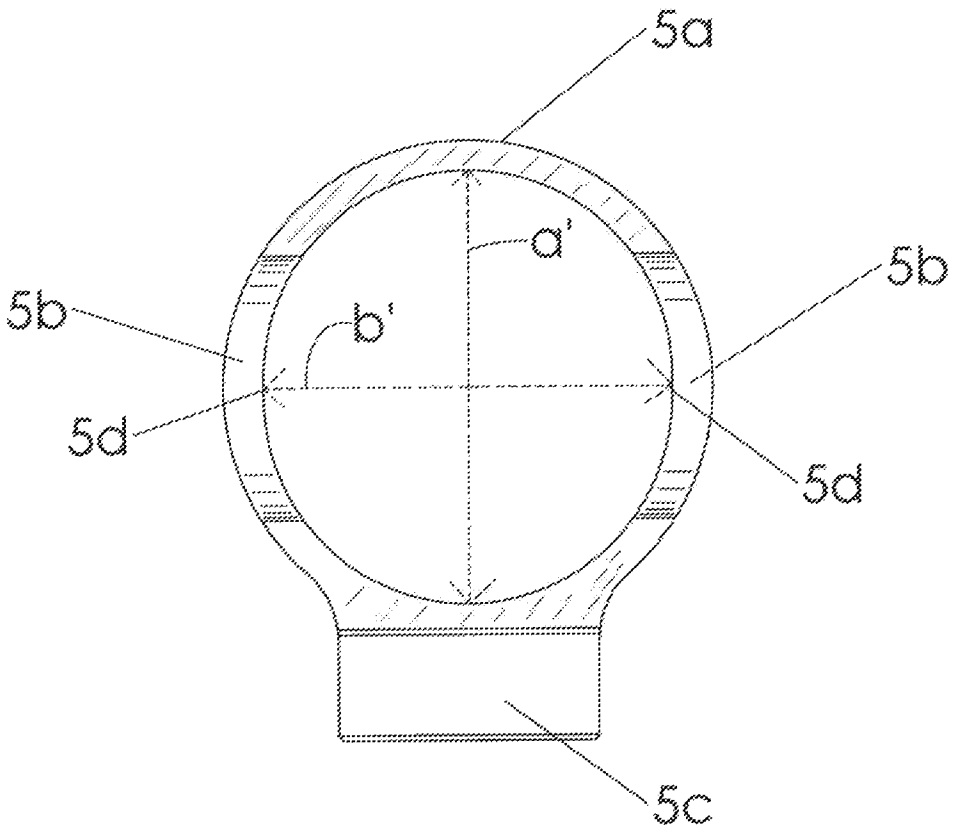
FIG. 13 is a front view of the bedding block of the present invention.

FIG. 13 is a front view of the bedding block of the present invention. In a preferred embodiment, the vertical inner diameter of the annular ring 5*a* (marked as a' in FIG. 13) is slightly greater than the horizontal inner diameter of the annular ring 5*a* (marked as b' in FIG. 13 and extending between the two strips 5*d*). This is to ensure that the strips 5*d* maintain a tight hold on the barrel and that the barrel has some room to rotate upwardly or downwardly on the hinge created by the lobes 5*b* and cutouts 6*c*. The horizontal inner diameter of the annular ring 5*a* is approximately the same as the outer diameter of the inner annular ring 6*b* of the bedding bushing 6. Note that the bedding block 5 is symmetrical right-to-left. The bedding bushing 6 is symmetrical both top-to-bottom and right-to-left. The bedding bushing 6 is designed to absorb the expansion forces created upon combustion, whereas the bedding block 5 is designed to redirect the recoil moment along the longitudinal axis of the barrel. In tandem, the bedding block 5 and the bedding bushing 6 work together to reduce or eliminate barrel harmonics and recoil.

Figure 14:
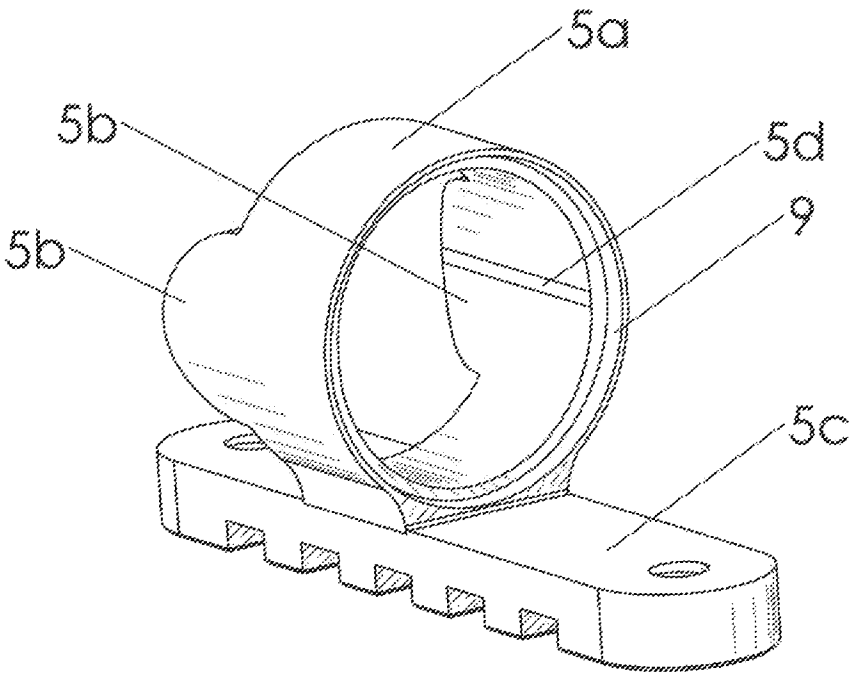
FIG. 14 is rear perspective view of the bedding block of the present invention.

FIG. 14 is rear perspective view of the bedding block of the present invention. This figure shows the circumferential groove 9 into which the optional wave spring 8 is inserted. Obviously, if a wave spring 8 is not used, there would be no need for the circumferential groove 9 in the bedding block 5.

FIG. 15 is a perspective view of an alternate embodiment of the bedding block of the present invention. The purpose of this figure is to illustrate the fact that the bedding block 5 of the present invention may take different forms, as long as it is comprised of an annular ring 5*a* with lobes 5*b*. The mounting bracket 5*c* shown in this figure is also different than that shown in the previous figures. The other structural aspects of the invention-namely, the longitudinal strips 5*d* on the inner surface of the annular ring 5*a* and the hinge that is created by the lobes 5*b* and the cutouts 6*c*—are the same as previously described.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A bedding assembly for a rifle comprising:

(a) a bedding block; and (b) a bedding bushing;

wherein the rifle has a barrel, and the barrel has a longitudinal axis;

wherein the bedding block and bedding bushing each has a central bore;

wherein the central bore of the bedding block and the central bore of the bedding bushing each has a longitudinal axis;

wherein the longitudinal axis of the bedding block and the longitudinal axis of the bedding bushing are aligned with each other to form a common longitudinal axis;

wherein the common longitudinal axis formed by the bedding block and the bedding bushing is aligned with the longitudinal axis of the barrel;

wherein the bedding block comprises an annular ring and two opposing lobes that extend forwardly from a front end of the annular ring;

wherein each lobe has a curved surface that extends outwardly from the front end of the annular ring;

wherein the bedding bushing is comprised of an outer annular ring and an inner annular ring, the outer annular ring being situated forwardly of the inner annular ring;

wherein the outer annular ring of the bedding bushing has an outer diameter, the inner annular ring of the bedding bushing has an outer diameter, and the outer diameter of the outer annular ring is greater than the outer diameter of the inner annular ring;

wherein the inner annular ring of the bedding bushing is configured to fit within the annular ring of the bedding block;

wherein the outer annular ring of the bedding bushing comprises two cutouts that are configured to receive the two opposing lobes of the bedding block;

wherein the annular ring of the bedding block comprises an interior surface, and the interior surface of the annular ring comprises two opposing longitudinal strips; and wherein the barrel comprises a breech end, and both the bedding block and the bedding bushing are configured to receive the breech end of the barrel.

2. The bedding assembly of claim 1, further comprising a wave spring;

wherein the bedding block comprises a rear circumferential groove that is configured to receive the wave spring.

3. The bedding assembly of claim 1, wherein each lobe is in the form of a semi-circle.

4. The bedding assembly of claim 1, wherein the annular ring of the bedding block has an interior curvature;

wherein each lobe has an interior surface; and wherein the interior surface of each lobe is concave to match the interior curvature of the annular ring of the bedding block.

5. The bedding assembly of claim 1, wherein the bedding block and the two opposing lobes are a single machined part.

6. The bedding assembly of claim 1, wherein the rifle comprises a stock; and wherein the bedding block further comprises a mounting bracket that is configured to attach the bedding block to the stock.

7. The bedding assembly of claim 1, wherein the outer annular ring of the bedding block and the inner annular ring of the bedding bushing are a single machined part.

8. The bedding assembly of claim 1, wherein the outer annular ring of the bedding bushing has a front edge; and wherein the front edge of the bedding bushing is beveled.

9. The bedding assembly of claim 1, wherein the annular ring of the bedding block comprises a front edge;

wherein the outer annular ring of the bedding bushing comprises a rear circumferential edge; and wherein the bedding block and the bedding bushing are configured so that the rear circumferential edge of the outer annular ring of the bedding bushing faces but does not come into contact with the front edge of the annular ring of the bedding block so as to create a first gap between the front edge of the annular ring of the bedding block and the rear circumferential edge of the bedding bushing.

10. The bedding assembly of claim 9, wherein the rifle comprises a receiver;

wherein the bedding block comprises a rear surface;

wherein the inner annular ring of the bedding bushing is longer than the annular ring of the bedding block, thereby creating a second gap between the rear surface of the bedding block and a front end of the receiver;

wherein the inner annular ring of the bedding bushing comprises a rear face; and wherein the rear face of the inner annular ring of the bedding bushing is configured to abut up against the front end of the receiver.

11. The bedding assembly of claim 1, wherein each of the flat longitudinal strips extends from a rear edge of the annular ring of the bedding block to a front edge of one of the two opposing lobes.

12. The bedding assembly of claim 1, wherein each of the flat longitudinal strips is parallel with a longitudinal center of the annular ring of the bedding block and parallel with the longitudinal axis of the barrel;

wherein each of the two flat longitudinal strips has a central longitudinal axis; and wherein the flat longitudinal strips are configured so that a line drawn between the central longitudinal axis of each of the flat longitudinal strips would intersect the longitudinal axis of the barrel.

13. The bedding assembly of claim 1, wherein the annular ring of the bedding block has a vertical inner diameter and a horizontal inner diameter; and wherein the vertical inner diameter of the bedding block is greater than the horizontal inner diameter of the bedding block.

14. The bedding assembly of claim 13, wherein the inner annular ring of the bedding bushing has an outer diameter; and wherein the horizontal inner diameter of the annular ring of the bedding block is approximately equal to the outer diameter of the inner annular ring of the bedding bushing.

15. The bedding assembly of claim 1, wherein the bedding bushing is symmetrical from top-to-bottom and from right-to-left.

16. The bedding assembly of claim 1, wherein the bedding bushing has a constant inner diameter.

17. A bedding assembly for a rifle comprising:

a bedding block;

wherein the rifle comprises a barrel, and the barrel is attached to a receiver assembly;

wherein the barrel has a longitudinal axis;

wherein the receiver assembly is attached to a stock by means of the bedding block;

wherein the bedding block is pivotally attached to the barrel, thereby forming an axis of pivotal attachment of the bedding block to the barrel; and wherein the axis of pivotal attachment of the bedding block to the barrel is horizontally perpendicular to and intersects the longitudinal axis of the barrel.

* * * * *